US005342821A

United States Patent [19]

Pearce

[11] Patent Number: 5,342,821

[45] Date of Patent: Aug. 30, 1994

[54] DYE MIGRATION BARRIER LAYER FOR DUAL LAMINATE PROCESS FOR THERMAL COLOR PROOFING

[75] Inventor: Glenn T. Pearce, Fairport, N.Y.

[73] Assignee: Eastman Kodak Company, Rochester, N.Y.

[21] Appl. No.: 145,893

[22] Filed: Oct. 29, 1993

[51] Int. Cl.[5] ..... B41M 5/035; B41M 5/38

[52] U.S. Cl. ..... 503/227; 156/235; 156/237; 156/240; 428/195; 428/206; 428/327; 428/500; 428/913; 428/914

[58] Field of Search ..... 156/235, 237, 239, 240; 8/471; 428/195, 206, 327, 500, 913, 914; 503/227

[56] References Cited

U.S. PATENT DOCUMENTS 5,053,381 10/1991 Chapman et al. ..... 503/227

FOREIGN PATENT DOCUMENTS 2258843A 2/1993 United Kingdom ..... 503/227

*Primary Examiner*—B. Hamilton Hess

*Attorney, Agent, or Firm*—Harold E. Cole

[57] ABSTRACT

A process for forming a color image which may be used to represent a printed color image to be obtained from a printing press comprising (a) forming a thermal dye transfer image in a polymeric dye image-receiving layer of an intermediate dye-receiving element by imagewise-heating a dye-donor element and transferring a dye image to the dye image-receiving layer, (b) applying a dye-migration barrier layer to one surface of a paper substrate, and (c) transferring the imaged polymeric dye image-receiving layer to the surface of the paper having the dye-migration barrier layer applied thereon; the dye-migration barrier layer comprising (a) crosslinked polymeric particles whose average diameter is equal to or less than about one-half the thickness of the layer; or (b) a polymer containing a polymeric crystallizable plasticizer that is at least partially compatible with the polymer and which has a crystalline melting point of less than about 135° C.

17 Claims, No Drawings

DYE MIGRATION BARRIER LAYER FOR DUAL LAMINATE PROCESS FOR THERMAL COLOR PROOFING

This invention relates to a thermal dye transfer process for obtaining a color image which may be used to represent a printed image to be obtained from a printing press, and more particularly to the use of a particular dye migration barrier layer in the resulting color image to control dye smear and to provide its use in an automatic laminating and delaminating device without rough edge tear and mechanical jams.

In order to approximate the appearance of continuous-tone (photographic) images via ink-on-paper printing, the commercial printing industry relies on a process known as halftone printing. In halftone printing, color density gradations are produced by printing patterns of dots of various sizes, but of the same color density, instead of varying the color density uniformly as is done in photographic printing.

There is an important commercial need to obtain a color proof image before a printing press run is made. It is desired that the color proof will accurately represent the image quality, details, color tone scale and, in many cases, the halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled.

In U.S. Pat. No. 5,126,760, the disclosure of which is incorporated by reference, a thermal dye transfer process is described for producing a direct digital, halftone color proof of an original image. The proof is used to represent a printed color image obtained from a printing press. The process described therein comprises:

a) generating a set of electrical signals which is representative of the shape and color scale of an original image;

b) contacting a dye-donor element comprising a support having thereon a dye layer and an infrared-absorbing material with a first intermediate dye-receiving element comprising a support having thereon a polymeric, dye image-receiving layer;

c) using the signals to imagewise-heat by means of a diode laser the dye-donor element, thereby transferring a dye image to the first dye-receiving element; and d) retransferring the dye image to a second final dye image-receiving element which has the same substrate as the printed color image.

As set forth in U.S. Pat. No. 5,126,760 described above, an intermediate dye-receiving element is used with subsequent retransfer to a second receiving element to obtain the final color proof. In the above process, the second or final receiving element can have the same substrate as that to be used for the actual printing press run. This allows a color proof to be obtained which most closely approximates the look and feel of the printed images that will be obtained in the actual printing press run. A multitude of different substrates can be used to prepare the color proof (the second receiver); however, there needs to be employed only one intermediate receiver.

For thermal dye transfer color proofing, the intermediate receiver can be optimized for efficient dye uptake without dye-smearing or crystallization. In the retransfer step, the dyes and receiver binder may be transferred together to the second receiver, or the dyes alone may be transferred where the second receiver is receptive to the dyes. Preferably, the dyes and receiver binder are transferred together to the final color proof receiver in order to maintain image sharpness and overall quality, which may be lessened when the dyes are retransferred alone to the final receiver.

While thermal dye transfer color proofing systems as described above have substantial advantages, it has been found that even where the transferred dyes and binder of the intermediate receiver are transferred together to the final color proof paper stock, a dye image spread or smear problem may result due to dyes migrating from the transferred binder to the paper stock. Such image smear can be particularly detrimental for halftone patterns in view of the minute dot size used to form such patterns. It would be desirable to provide a thermal dye transfer process for obtaining a high quality color proof which would minimize such a dye smear problem and which would be applicable to a variety of printer stock papers.

In U.S. Pat. No. 5,053,381, the above process is improved by applying a dye migration barrier layer to the paper substrate and transferring the imaged polymeric dye image-receiving layer to the surface of the paper having the dye migration barrier layer applied thereon. The application of the dye-migration barrier layer prevents dye smear and spreading due to migration of dye into the paper, resulting in a high quality color image of increased durability and prolonged usefulness. This process has been commercialized in the KODAK APPROVAL® digital color proofing system wherein the 4-color image is transferred to the intermediate receiver element in the KODAK APPROVAL® System Image Writer, described in U.S. Pat. No. 5,168,288. The transfer of the dye migration barrier layer to the paper substrate and subsequent transfer of the imaged polymeric dye image-receiving layer to the pre-laminated paper is performed off line and automatically in a mechanical device, the KODAK APPROVAL® Laminator, described in U.S. Pat. No. 5,203,942.

There are problems encountered in the operation of the KODAK APPROVAL® Laminator during the lamination of the dye migration barrier layer to the paper substrate under the influence of heat and pressure. In particular, there are problems during automatic delamination of the dye migration barrier layer from the support and transport of the spent support to a separate exit path for disposal. In the following description, the sheet comprising the dye migration barrier layer and the support will be referred to as the pre-laminate sheet.

During lamination, the paper is mounted on a rotating heated drum and is pressed against the prelaminate sheet by an opposing heated roller on the backside of the pre-laminate sheet. Most importantly, application of heat and pressure does not cover the entire pre-laminate sheet. There is a small nontransferred area at the leading edge of the prelaminate sheet. This non-laminated and non-transferred margin is not adhered to the paper and thereby serves as a means by which a mechanical element, such as a pick or skive, can guide the pre-laminate support away from the paper and towards an attachment device for complete delamination and removal. In such a process, the "break line" in the dye migration barrier layer is required to break cleanly when the pre-laminate support is pulled away from the dye migration barrier layer-laminated paper area. Furthermore, this break must occur without the assistance of a mechanical knife, or penetrating ridge on either the drum or back-side roller.

In commercial operation of such a laminator with pre-laminate sheets as described in U.S. Pat. No. 5,053,381, poly(vinyl alcohol-co-butyral) is used as the dye-migration barrier layer. When this material is used, the break line does not occur in a clean and sharp manner. Instead, a rough and irregular break zone is often produced and, in the worst cases, pieces of stretched dye migration barrier polymer can extend into the laminate area as much as one inch or more, particularly when the drum and fuser roller are not properly warmed to operating temperatures. Even though the rough edge is covered with the polymer from the intermediate dye-receiver sheet, which is slightly larger than the transferred pre-laminate area, the rough edge is still visible in the final print image as an undesirable blemish, particularly the long extensions of the stretched barrier layer polymer. The rough edge is also visible on the spent pre-laminate support.

In addition to the print blemishes, there are serious problems caused by dye migration barrier layers comprising single polymer matrices, such as poly(vinyl alcohol-co-butyral), relating to transport devices and surfaces in such process laminators. When a dye migration barrier layer of poly(vinyl alcohol-co-butyral) is used, it does not break cleanly, but rather stretches and elongates several inches. Such stretching lasts typically as long as five seconds and as long as ten seconds in extreme cases. The stretching can easily occur because the drum and fuser roller temperatures are typically above the Tg of the polymer layer, a condition required for good adhesion of the barrier layer to the paper. Eventually, the stretched section, which has a "taffy"-like appearance, will break at any point giving rise to the rough edges and print blemishes on the leading edges of the printed image. The rough edge can also be easily viewed on the spent pre-laminate support. Occasionally, pieces of the taffy-like section will break free and become deposited on rollers and other transport surfaces, causing a catastrophic machine jam and shutdown requiring immediate service.

UK Patent Application GB 2,258,843A describes a transfer sheet for an image forming method using thermal transfer of a polymer layer by means of heat from a resistive thermal head. A clean break is accomplished by heating the edges of the patch to be transferred more than the interior area. Use of this technique in the laminator described would require a costly machine modification.

It is an object of this invention to provide an improved dye migration barrier layer that breaks cleanly and sharply at the intended boundary between the transferred and non-transferred area, is transparent or translucent, separates easily from the pre-laminate sheet support, adheres to the paper substrate, and forms an effective barrier to dye migration into the paper.

These and other objects are achieved in accordance with the invention which comprises a process for forming a color image which may be used to represent a printed color image to be obtained from a printing press comprising (a) forming a thermal dye transfer image in a polymeric dye image-receiving layer of an intermediate dye-receiving element by imagewise-heating a dye-donor element and transferring a dye image to the dye image-receiving layer, (b) applying a dye-migration barrier layer to one surface of a paper substrate, and (c) transferring the imaged polymeric dye image-receiving layer to the surface of the paper having the dye-migration barrier layer applied thereon; the dye-migration barrier layer comprising:

(I) crosslinked polymeric particles whose average diameter is equal to or less than about one-half the thickness of the layer; or (II) a polymer containing a polymeric crystallizable plasticizer that is at least partially compatible with the polymer and which has a crystalline melting point of less than about 135° C.

The dye-donor element that is used in the process of the invention comprises a support having thereon a heat transferable dye-containing layer. The use of dyes instead of pigments in the dye-donor provides for a wide selection of hues and colors so that a closer match to a variety of printing inks can be achieved. Also, images are more readily transferred one or more times to a receiver if desired. Furthermore, the use of dyes allows one to easily modify density to any desired level.

Any dye can be used in the dye-donor employed in the invention provided it is transferable to the dye-receiving layer by the action of the heat. Especially good results have been obtained with sublimable dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination.

In color proofing in the printing industry, it is important to be able to match the proofing ink references provided by the International Prepress Association. These ink references are density patches made with standard 4-color process inks and are known as SWOP (Specifications Web Offset Publications) Color References. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, p.55. Preferred dyes and dye combinations found to best match the SWOP Color References are found in U.S. Pat. Nos. 5,024,990; 5,023,229; and 5,081,101, the disclosures of which are incorporated by reference.

The dyes of the dye-donor element employed in the invention may be used at a coverage of from about 0.05 to about 1 g/m$^2$, and are dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; a polycarbonate; poly(vinyl acetate); poly(styrene-co-acrylonitrile); a polysulfone; a poly(vinyl acetal) such as poly(vinyl alcohol-co-butyral); or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat needed to transfer the sublimable dyes. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 Bm. It may also be coated with a subbing layer, if desired, such as those materials described in U.S. Pat. Nos. 4,695,288 or 4,737,486.

The intermediate or first dye-receiving element that is used in the process of the invention comprises a support having thereon a dye image-receiving layer. The support may be a polymeric film such as a poly(ether sulfone), a polyimide, a cellulose ester such as cellulose acetate, a poly(vinyl alcohol-co-acetal) or a poly(ethylene terephthalate). The intermediate support thickness is not critical, but should provide adequate dimensional stability. In general, polymeric film supports of from 5 to 500 μm are used. The intermediate dye-receiving element support may be clear, opaque, and/or diffusely or specularly reflective. Opaque (e.g. resin-coated paper) and reflective (e.g. metal-coated polymeric film) supports are preferred when a laser system is used to form the dye image in the dye image-receiving layer, and such supports are the subject matter of copending U.S. Ser. No. 606,404 of Kaszczuk et al., filed Oct. 31, 1990, the disclosure of which is incorporated by reference. The intermediate dye-receiving element may also have a cushion layer between the support and the dye-receiving layer, as disclosed in U.S. Ser. No. 749,026 of Kaszczuk, filed Aug. 23, 1991, the disclosure of which is incorporated by reference.

The dye image-receiving layer may comprise, for example, a polycarbonate, a polyurethane, a polyester, poly(vinyl chloride), cellulose esters such as cellulose acetate butyrate or cellulose acetate propionate, poly(styrene-co-acrylonitrile), polycaprolactone, polyvinyl acetals such as poly(vinyl alcohol-co-butyral), mixtures thereof, or any other conventional polymeric dye-receiver material provided it will adhere to the second receiver. The dye image-receiving layer may be present in any amount which is effective for the intended purpose. In general, good results have been obtained at a concentration of from about 0.2 to about 10 g/m$^2$.

The dye-donor elements employed in the invention may be used with various methods of heating in order to transfer dye to the intermediate receiver. For example, a resistive thermal head or a laser may be used.

When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material. The laser radiation is then absorbed into the dye layer and converted to heat by a molecular process known as internal conversion.

Lasers which can be used to transfer dye from dye-donors employed in the invention are available commercially. There can be employed, for example, Laser Model SDL-2420-H2 from Spectro Diode Labs, or Laser Model SLD 304 V/W from Sony Corp.

In the above process, multiple dye-donors may be used to obtain a complete range of colors in the final image. For example, for a full-color image, four colors: cyan, magenta, yellow and black are normally used.

Thus, in a preferred embodiment of the process of the invention, a dye image is transferred by imagewise heating a dye-donor containing an infrared-absorbing material with a diode laser to volatilize the dye, the diode laser beam being modulated by a set of signals which is representative of the shape and color of the original image, so that the dye is heated to cause volatilization only in those areas in which its presence is required on the dye-receiving layer to reconstruct the color of the original image.

Spacer beads may be employed in a separate layer over the dye layer of the dye-donor in the abovedescribed laser process in order to separate the dye-donor from the dye-receiver during dye transfer, thereby increasing its uniformity and density. That invention is more fully described in U.S. Pat. No. 4,772,582, the disclosure of which is hereby incorporated by reference. Alternatively, the spacer beads may be employed in or on the receiving layer of the dye-receiver as described in U.S. Pat. No. 4,876,235, the disclosure of which is hereby incorporated by reference. The spacer beads may be coated with a polymeric binder if desired.

In a further preferred embodiment of the invention, an infrared-absorbing dye is employed in the dye-donor element instead of carbon black in order to avoid desaturated colors of the imaged dyes from carbon contamination. The use of an absorbing dye also avoids problems of uniformity due to inadequate carbon dispersing. For example, cyanine infrared-absorbing dyes may be employed as described in U.S. Pat. No. 4,973,572 or other materials as described in U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference.

A thermal printer which uses the laser described above to form an image on a thermal print medium is described and claimed in copending U.S. Pat. No. 5,168,288 discussed above.

As noted above, after the dye image is obtained on a first dye-receiving element, it is retransferred to a second or final receiving element in order to obtain a final color proof. The final receiving element comprises a paper substrate to which has been applied a dye-migration barrier layer. The substrate thickness is not critical and may be chosen to best approximate the prints to be obtained in the actual printing press run. Examples of substrates which may be used for the final receiving element (color proof) include the following: Adproof® (Appleton Paper), Flo Kote Cove® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Consolith Gloss® (Consolidated Papers Co.) and Mountie Matte® (Potlatch Inc.).

The crosslinked polymer particles used in one embodiment of the dye-migration barrier layer of this invention may be formed of vinyl homopolymers or copolymers such as polyacrylates and methacrylates, poly(vinyl halides), poly(vinylalkyl esters), and polystyrenes, or poly(vinyl alcohol-co-acetals), vinyl ethers and their copolymers, phenol resins, melamine resins, epoxy resins, silicone resins, polyalkenes such as polyethylene, polybutadiene, polypropylene, isobutylene, and their copolymers; polyesters, polyurethanes, polyimides, etc., provided the particles can be crosslinked during their formation by any means available to those skilled in the art.

Preferably, the particles are coated on the support from a solvent that swells or softens the particles, such as a solvent that would dissolve the polymer comprising the particle if it were not crosslinked. Although the exact mechanism of action that provides the sharp breaking property is not entirely understood, it is believed that the combination of solvent swelling with a small particle size leads to what appears to be a clear continuous film when the coating dries, but that due to the crosslinking, the individual identities of the particles are maintained thus providing a more disruptable layer.

Aqueous dispersions or latex's of the polymer particles may also be utilized provided they are coated in a manner that leads to a transparent or translucent film.

The average particle diameter should be no larger than one-half the thickness of the dye migration barrier layer itself, and preferably it is less than one tenth the thickness of the layer. In layers of approximately 4 μm thick, particle diameters less than 0.1 μm are preferred. When the particles are coated alone or in combination with polymer binders and other addenda, total coverages of from 0.1 to 5 g/m$^2$ are useful, with a preferred range being between 3 to 5 g/m$^2$. The particle content of the coating is about 25 to 100 percent, preferably 50 to 100 percent, by weight of the total laydown.

A preferred class of particles useful in the invention is described by D. Y. Meyers et al. in U.S. Pat. No. 4,708,923, as crosslinked particles less than one μm in diameter derived from aqueous emulsion polymerization of vinyl monomers which include a difunctional monomer, and are removed from the aqueous medium in dry form and dispersed in the appropriate solvent. A preferred composition range of the particles described in Meyers et al. that are most useful in this invention comprises (a) 50 to 75 weight percent of monomers selected from methacrylate esters of linear or branched alkyl groups of 4 or fewer carbon atoms, (b) 15 to 49 weight percent of monomers selected from acrylate esters of linear or branched alkyl groups of 4 or more carbon atoms or methacrylate esters of linear or branched alkyl groups of 8 or more carbon atoms, and (c) 1 to 10 weight percent difunctional monomers such as divinylbenzene and ethylene glycol dimethacrylate. A preferred embodiment comprises 67 weight percent iso-butyl methacrylate, 31 weight percent 2-ethylhexyl methacrylate, and 2 weight percent divinylbenzene with a particle size of 0.05–0.1 μm.

The above-described crosslinked polymeric particles may be used in a layer alone or mixed with a polymer binder. Such polymeric binders are described in U.S. Pat. No. 5,053,381 and include any material which limits the tendency of the transferred halftone dye image dots from spreading due to migration into the paper substrate. The polymer is preferably the same as the one used in the dye-receiving layer of the intermediate dye-receiving sheet. In a preferred embodiment, poly(vinyl alcohol-co-butyral) (9–13 percent vinyl alcohol) is used.

The dye migration barrier layer is preferably thin so as to not affect the appearance of the final color image, while still thick enough to provide adequate protection against migration of the dye image into the paper substrate. In general, coverages of from 0.1 to 5 g/m$^2$ are preferred.

In another embodiment of the invention, crystallizable plasticizers are employed in combination with a polymeric binder. The crystallizable plasticizers can be linear or branched polymeric or oligomeric polyesters, polyethers, polyglycols, polyamides, polycarbonates, polyethylenes, polyvinylalkyls, polyalkyldienes, polyurethanes and the like, with the proviso that the plasticizer is at least partially compatible with the dye migration barrier polymer in the coated form, and that its crystalline melting point is less than about 135° C. The molecular weights of the plasticizer polymers can range from 2000 to 100,000 weight average, with a preferred range of 3000 to 50,000. The polymeric plasticizers of this invention may also include block or graft copolymers wherein at least one segment contains crystalline elements as defined above.

A preferred class of plasticizer polymers are polyesters with the following general structures:

$$\text{(I)}—[—CO—O—(CH_2)_x—]— \text{ or}$$

$$\text{(II)}—[—CO—(CH_2)_x—CO—O—(CH_2)_y—O—]—$$

where x and y can be any integer greater than 1.

Polymers of formulas (I) and (II) may also contain structural elements of multiple functionality for the purpose of introducing chain branching, provided the branching does not completely eliminate crystallinity. Preferred embodiments include for formula (I) polycaprolactone, and for formula (II) a copolyester of 1,12-dodecanedioic acid and 1,6-hexanediol with 0.1–10 mole % trimethylolpropane, with the preferred molecular weights of both types at 10,000–40,000 weight average. The plasticizers are employed as addenda to the dye migration barrier layer polymer in a ratio of from 1:100 to 1:4, and preferably from 1:20 to 1:8, plasticizer-to-barrier polymer by weight.

The dye migration barrier layers of this invention may also include other addenda not directly related to the problems solved by the above mentioned materials. For example, large beads which protrude above the surface of the coating may be included for the purpose of feel, whereby the user can identify the side of the support with the barrier polymer for proper insertion into the laminator device. In preferred embodiments comprising 4 g/m$^2$ barrier layer polymer, beads of 10 to 14 μm average diameter are typically employed at coverages of 0.05 to 0.1 g/m$^2$. In addition, coating formulations may include surfactants and spreading agents to insure coating uniformity.

The dye-migration barrier layer is preferably thin so as to not affect the appearance of the final color image, while still thick enough to provide adequate protection against migration of the dye image into the paper substrate. In general, coverages of from 0.1 to 5 g/m$^2$ are preferred for polymeric dye-migration barrier layers.

The dye-migration barrier layer may be applied to the paper substrate by any conventional method such as extrusion coating, solvent coating, or lamination. In a preferred embodiment, the dye-migration barrier layer is a polymeric layer preformed on a support, which is then laminated to the paper substrate. The support can then be separated from the dye-migration barrier layer. This layer application can be accomplished, for example, by passing the paper substrate and the polymeric dye-migration barrier layer with support between a pair of heated rollers to form a laminate, and then stripping the support away. Other methods of transferring the dye-migration barrier layer from its support to the final receiver substrate could also be used such as using a heated platen, using a resistive thermal head, other conventional use of pressure and/or heat, external heating, etc. To facilitate separation, release agents may be included within or between the dye-migration barrier layer and its support. For example, conventional silicone based materials or hydrophilic cellulosic materials may be used. Useful supports for the dye-migration barrier layer include those listed above for the intermediate dye-receiving element.

The imaged, intermediate dye image-receiving layer may be transferred to the final receiver (color proof substrate with dye-migration barrier layer) in a similar manner of passing between two heated rollers, use of a heated platen, use of a resistive thermal head, use of other forms of pressure and/or heat, external heating, etc., to form a laminate with the imaged intermediate dye image-receiving layer adhered to the dye-migration barrier layer. Preferably, the intermediate receiver element support is separated from the dye-image receiving layer after it is laminated to the paper substrate. Release agents as described above may also be included between or within the intermediate receiver support and dye image-receiving layer to facilitate separation. The use of release layers comprising mixtures of hydrophilic cellulosic materials and poly(ethylene glycol) between metal-coated supports and dye image-receiving layers is the subject matter of U.S. Pat. No. 5,077,163, the disclosure of which is incorporated by reference.

Also as noted above, a set of electrical signals is generated which is representative of the shape and color of an original image. This can be done, for example, by scanning an original image, filtering the image to separate it into the desired basic colors (red, blue and green), and then converting the light energy into electrical energy. The electrical signals are then modified by computer to form the color separation data which may be used to form a halftone color proof. Instead of scanning an original object to obtain the electrical signals, the signals may also be generated by computer. This process is described more fully in Graphic Arts Manual, Janet Field ed., Arno Press, New York 1980 (p. 358ff), the disclosure of which is hereby incorporated by reference.

The dye-donor element employed in the invention may be used in sheet form or in a continuous roll or ribbon. If a continuous roll or ribbon is employed, it may have alternating areas of different dyes or dye mixtures, such as sublimable cyan and/or yellow and/or magenta and/or black or other dyes. Such dyes, for example, are disclosed in the patents referred to above.

The following examples are provided to illustrate the invention.

EXAMPLE 1

This example compares the effectiveness of the polymeric particles of this invention with various particulate materials as comparisons. The specific materials used in this example and their designations in the text and tables are as follows:

| | |
|---|---|
| **Dye Migration Barrier Layer Polymer** | |
| Butvar B-76 ® (Monsanto Co.) | a poly(vinylbutyral-co-vinyl alcohol) (9–13% vinyl alcohol) Tg = 58° C., MW = 45–55,000 (Wt. Ave.) |
| **Particulate Addenda - Comparative Items** | |
| Aerosil 972 ® (Degussa Inc.) | Hydrophobically modified colloidal silica. |
| SDVB2 | Polystyrene-divinylbenzene beads (30% divinylbenzene, average diameter 2 μm (vol). |
| SCVB2X | Same as SDVB2, except that the surface silica used as a colloidal stabilizer was removed by an aqueous base wash prior to coating. |
| SDVB4 | Polystyrene-divinylbenzene beads (5% divinylbenzene), 4 μm (vol) average diameter. |
| **Micro Particulate Addenda - Invention** | |
| MP | Poly(isobutyl methacrylate-co-2-ethylhexyl methacrylate-co-divinylbenzene) (67/31/2 monomer weight ratio) prepared as described by Meyers et al., U.S. Pat. No. 4,708,923, preparation A. Particle size 0.05–0.1 μm. |

In addition to the above materials, all the dye migration barrier layer coatings of this example and all the subsequent examples of this invention contain spacer beads of poly(styrene-co-divinylbenzene) (0.086 g/m$^2$), (5% divinylbenzene), 12 μm average diameter (vol), for the purpose of coating side identification, and 0.01 g/m$^2$ DC-1248 (Dow Corning) surfactant.

The dye migration barrier layer coatings A-H(comparative), 1–3(invention), and the control were all formed by extruding on 100 μm poly(ethylene terephthalate) support, a 0.8 μm cushion layer of polyethylene, followed by a 25.4 cm. wide coating of the layer ingredients from 2-butanone at a solution laydown of 65 cc/m$^2$ with a single slot hopper. The dry laydowns of the layer ingredients are listed in Table 1.

The dye migration barrier layer coatings were all evaluated for rough edge tear and extent of stretching at the break line by utilizing the KODAK APPROVAL ® Laminator for transfer of the coated dye migration barrier layers to Champion Textweb paper. The drum temperature was set at 105° C., and the fuser roller at 125° C., which are the recommended optimum settings. The tendency for stretching at the break line was measured by timing with a stopwatch, the time interval from the start of separation of the dye migration barrier layer from its support to the final break of the last visible strand of stretched material.

These times, in seconds, are listed in Tables 1–3 under the column "Lamination Stretch Time". The lowest possible stretch time, indicating instantaneous break at the break line was 1 second. This minimum time was not zero because it was convenient to begin timing from the moment the skive moved back to its rest position, since this was a clearly visible and audible event that always occurred at the exact same point in relation to the movement of the drum. This backward skive motion occurred approximately 1 second before separation began.

A decrease in stretch times of 0.5 seconds was considered statistically significant. Significant and useful reductions in rough edge tear and stretching tendency were observed at a stretch time of about 4 seconds, and preferably, times of about 3 seconds or less were most desired. Times of less than 3.5 seconds resulted in leading edges, on both the laminated paper and spent prelaminate support, that were completely straight and sharp. The following results were obtained:

TABLE 1

| Coating | Butvar ® B-76 (g/m²) | Addenda (g/m²) | Lamination Stretch Time (sec.)* |
|---|---|---|---|
| Control | 4.0 | None | 5.3 |
| | Comparative Coatings | | |
| A | 3.1 | Aerosil 972 (0.9) | 8.3 |
| B | 2.0 | Aerosil 972 (4.1) | ** |
| C | 1.4 | Aerosil 972 (5.3) | ** |
| D | 2.0 | SDVB4 (2.0) | ** |
| E | 1.4 | SDVB4 (2.6) | ** |
| F | 2.0 | SDVB2 (2.0) | 5.8*** |
| G | 1.4 | SDVB2 (2.6) | ** |
| H | 2.0 | SDVB2X (2.0) | 5.4 |
| | Invention Coatings | | |
| 1 | None | MP (4.0) | 1.2 |
| 2 | 1.4 | MP (2.6) | 3.8 |
| 3 | 2.0 | MP (2.0) | 4.6 |

*The time in seconds from the start of delamination to complete break of the stretched layer at the leading edge of the transferred layer.
**The dye migration barrier layer did not transfer to the paper.
***Transfer of the dye migration barrier layer to the paper began successfully, but failed to transfer completely.

The data in Table 1 indicate that the crosslinked particles of this invention are superior to the silica particles and larger beads in providing a useful dye migration barrier layer that reduces rough edge tear and break line stretching. In comparative coatings B-G, the mode of failure was the inability of the layer to properly transfer to the paper, due either to poor adhesion to the paper, or inability to peel from the pre-laminate cushion layer/support. In the cases where proper transfer occurred, as in comparative coatings A and H, stretch times either increased, or remained unchanged.

In addition, the comparative coatings A-H all gave undesirably high levels of light scattering and insufficient transparency. In contrast, inclusion of the small crosslinked particles of this invention, either as full or partial replacement for the polymer Butvar B-76, gave significant reductions in stretch time and edge roughness as shown by Examples 1-3.

Four-color halftone printed images were prepared on Textweb paper containing the dye migration barrier layers in Examples 1-3 and the control, utilizing the KODAK APPROVAL ® SYSTEM (Eastman Kodak Co) Laminator, Image Writer, Intermediate Receiver sheet, and Dye Donor sheets, as described in U.S. Pat. No. 5,053,381. All the images made with invention coatings 1-3 displayed color densities, colorimitry (SWOP), image permanence, and resistance to dye migration comparable to the control.

EXAMPLE 2

This example compares the effectiveness of crystallizable plasticizers of this invention with conventional liquid plasticizers in reducing rough edge tear and break line stretching. The comparative liquid plasticizers cited below were recommended as effective Butvar ® plasticizers by Monsanto publication No. 6070F. In addition to the materials described in Example 1, the following plasticizers were used in the quantities indicated in Table 2.

| | |
|---|---|
| | Liquid Plasticizers - Comparative Items |
| DBS | Dibutyl sebicate |
| DBP | Dibutyl Phthalate |
| TBC | Tributyl citrate |
| | Crystallizable Plasticizers - Invention Items |
| PCL0260 | Polycaprolactone from Union Carbide, as Tone 0260 ®, MW = 3000, MP = 50-60° C. |
| PCL300 | Polycaprolactone from Union Carbide as Tone 300 ®, MW = 11,000, MP = 50-56° C. |
| PCL767 | Polycaprolactone from Union Carbide as Tone 767 ®, MW = 40,000, MP = 60-62° C. |
| PCL787 | Polycaprolactone from Union Carbide as Tone 787 ®, MW = 80,000, MP = 60-62° C. |
| PE612-1 | Polyester of 1,12 dodecanedioic acid and 1,6-hexanediol with 1-10 mole % trimethylolpropane branching agent MW = 16,000, MP = 70-72° C. Eastman Chemicals Co. |
| PE612-2 | As above, MW = 11,000, MP = 78° C. |
| PE612-3 | As above, MW = 5,800, MP = 76° C. |
| PE612-4 | As above, MW = 54,000, MP = 75° C. |
| PE612-5 | As above, MW = 26,000, MP = 63° C. |

The coatings and their respective ingredients for this example are listed in Table 2. As in the previous examples, all were coated from 2-butanone by the method of Example 1. Rough edge tear and lamination break times were evaluated as in Example 1, and the results listed in Table 2.

In addition to the optimum temperatures previously cited, some of the coatings were evaluated with the laminator set at 10 degrees lower (drum=95° C., fuser roller=115° C.) in order to simulate an insufficiently warmed laminator. Glass transition temperatures of the coated dye migration barrier layers (coatings I-K, 7,10,15, and the control) were determined by differential scanning colorimitry on samples obtained by peeling the coated layers off the polyethylene cushion layer/support. The following results were obtained:

TABLE 2

| Coating | Butvar ® B-76 (g/m²) | Addenda (g/m²) | Tg °C. | Lamination Stretch Time* (sec.) Std. Temp. ** | Lamination Stretch Time* (sec.) Low Temp. *** |
|---|---|---|---|---|---|
| Control | 4.0 | None | 67 | 5.5 | 10.3 |
| | Comparative Coatings With Liquid Plasticizers | | | | |
| I | 3.55 | DBS (0.43) | 48 | 6.3 | |
| J | 3.55 | DBP (0.43) | 54 | 7.3 | |
| K | 3.55 | TBC (0.43) | 50 | 8.0 | |
| | Invention Coatings With Crystallizable Plasticizers and Combinations With Micro Particles | | | | |
| 4 | 3.88 | PCL300 (0.11) | | 3.7 | |

TABLE 2-continued

| Coating | Butvar ® B-76 (g/m²) | Addenda (g/m²) | Tg °C. | Lamination Stretch Time* (sec.) Std. Temp. ** | Low Temp. *** |
|---|---|---|---|---|---|
| 5 | 3.77 | PCL300 (0.22) | | 2.9 | 5.3 |
| 6 | 3.66 | PCL300 (0.32) | | 2.6 | |
| 7 | 3.55 | PCL300 (0.43) | 49 | 2.5 | 4.1 |
| 8 | 3.12 | PCL300 (0.86) | | 3.6 | |
| 9 | 3.55 | PCL 0260 (0.43) | | 3.2 | |
| 10 | 3.55 | PCL767 (0.43) | 51 | 2.6 | 5.1 |
| 11 | 3.55 | PCL787 (0.43) | | 3.7 | |
| 12 | 3.88 | PE612-1 (0.11) | | 3.8 | |
| 13 | 3.77 | PE612-1 (0.22) | | 3.5 | 4.5 |
| 14 | 3.66 | PE612-1 (0.32) | | 2.7 | |
| 15 | 3.55 | PE612-1 (0.43) | 49 | 3.3 | 3.6 |
| 16 | 3.12 | PE612-1 (0.86) | | 4.5 | |
| 17 | 3.55 | PE612-2 (0.43) | | 3.6 | 4.0 |
| 18 | 3.55 | PE612-3 (0.43) | | 4.6 | 4.6 |
| 19 | 3.55 | PE612-4 (0.43) | | 4.0 | 3.8 |
| 20 | 3.55 | PE612-5 (0.43) | | 4.2 | 3.7 |
| 21 | 1.78 | MP (2)/ PCL300 (0.22) | | 2.6 | 3.6 |
| 22 | 1.78 | MP (2)/ PE612-1 (0.22) | | 2.9 | 4.1 |
| 23 | 1.18 | MP (2.6)/ PE612-1 (0.22) | | 1.9 | |
| 24 | 1.88 | MP (2)/ PE612-1 (0.11) | | 3.3 | 3.4 |
| 25 | 1.29 | MP (2.6)/ PE612-1 (0.11) | | 2.5 | |

*The time in seconds from the start of delamination to complete break of the stretched layer at the leading edge of the transferred layer.
**Std. Temp. is the optimum laminator temperature settings of 105/125° C. Drum/-Fuser Roller
***Low Temp. is the lowest possible temperature settings of 95/115° C. Drum/-Fuser Roller The data in Table 2 clearly indicate the utility of the crystallizable plasticizers (Invention examples 4–25) in dramatically reducing lamination stretch time and rough edge tear, in contrast to the control or to the liquid plasticizers (comparative coatings I-J) which show either no change or an increase in stretch time. The glass transition data indicate that both the liquid and the crystallizable plasticizers were equally effective in lowering the softening temperature of the layers, but only the crystallizable materials of this invention were effective in reducing break line stretching.

The lamination stretch times (Table 2) obtained at the low temperature settings also demonstrate the utility of the materials of this invention, particularly for enhancing the range of temperatures at which problem-free laminations can occur. It is noteworthy that at the low temperature settings where the control exhibited a catastrophic failure in rough edge and mechanical jams, some of the invention coatings (15, 19, 20, 21, 24) gave short break times under 4 seconds and sharp edge break lines. Coatings 21–25 demonstrated that combinations of the micro particles and crystallizable plasticizers gave enhanced improvements indicating that their beneficial effects were additive.

Four-color halftone printed images were prepared on Textweb paper containing the dye migration barrier layers in coatings 5, 7, 10, 13, 15, 21–25, and the control, as described in Example 1. All the images made with the invention coatings displayed color densities, colorimitry (SWOP), image permanence, and resistance to dye migration comparable to the control.

EXAMPLE 3

This example compares two other polymer materials as dye migration barrier layer polymers, with the Butvar B-76 ® used in all the previous coatings, in combination with crystallizable plasticizers and crosslinked micro particles cited above. The materials employed were:

| | |
|---|---|
| ACRYLOID ® B-44 | Poly(methyl methacrylate-co-n-butyl methacrylate) resin from Rohm & Haas, Tg = 60° C. |
| PETBA | A linear polyester comprised of terephthalic acid, 50 mole percent ethylene glycol, and 50 mole percent 4,4''-bis(2-hydroxyethyl)-bisphenol A. Tg = 80° C., MW = 54–64,000. |

The coatings and their respective ingredients for this example are listed in Table 3, with coatings 26–28 and control-1 and-2 coated from 2-butanone by the method of Example 1, and coatings 29–31 and control-3 coated from dichloromethane with DC-510 (Dow Corning) at 0.011 g/m² added as a coating aid. Rough edge and lamination break times were evaluated as in Example 1, with the following results:

TABLE 3

| Coating | Barrier Polymer (g/m²) | Addenda (g/m²) | Lamination Stretch Time (sec.)* |
|---|---|---|---|
| Control-1 | Butvar ® B-76 (4.0) | None | 6.7 |
| Control-2 | Acryloid ® B-44 (4.0) | None | 5.1 |
| 26 | Acryloid ® B-44 (3.6) | PCL300 (0.43) | 1.6 |
| 27 | Acryloid ® B-44 (3.6) | PE612-1 (0.43) | 3.7 |
| 28 | Acryloid ® B-44 (2.0) | MP (2.0) | 2.8 |
| Control-3 | PETBA (4.0) | None | 3.3 |
| 29 | PETBA (3.6) | PCL300 (0.43) | 1.0 |
| 30 | PETBA (3.6) | PE612-1 (0.43) | 1.0 |
| 31 | PETBA (2.0) | MP (2.0) | 1.6 |

The above results show the utility of the materials of this invention in a multiplicity of dye migration barrier layer polymers.

The invention has been described in detail with particular reference to preferred embodiments thereof, but it will be understood that variations and modifications can be effected within the spirit and scope of the invention.

What is claimed is:

1. A process for forming a color image comprising:

(a) forming a thermal dye transfer image in a polymeric dye image-receiving layer of an intermediate dye-receiving element by imagewise-heating a dye-donor element and transferring a dye image to said dye image-receiving layer, (b) applying a dye-migration barrier layer having a given thickness to one surface of a paper substrate, and (c) transferring the imaged polymeric dye image-receiving layer to said surface of said paper substrate having said dye-migration barrier layer applied thereon;

said dye-migration barrier layer comprising:

(I) crosslinked polymeric particles whose average diameter is equal to or less than about one-half the thickness of said dye-migration barrier layer; or (II) a polymer containing a polymeric crystallizable plasticizer that is at least partially compatible with said polymer and which has a crystalline melting point of less than about 135° C.

2. The process of claim 1 wherein said dye-migration barrier layer comprises a polymeric binder containing said crosslinked polymeric particles.

3. The process of claim 1 wherein said dye-migration barrier layer comprises a polymer containing a crystallizable plasticizer which is a polyester having the formula:

$$(I)—[—CO—O—(CH_2)_x—]— \text{ or}$$

$$(II)—[—CO—(CH_2)_x—CO—O—(CH_2)_y—O—]—$$

where x and y can be any integer greater than 1.

4. The process of claim 3 wherein said polymer is poly(vinyl alcohol-co-butyral) and said crystallizable plasticizer is poly(caprolactone).

5. The process of claim 1 wherein said dye-migration barrier layer is applied to said paper substrate by heat lamination.

6. The process of claim 1 wherein step (b) comprises laminating an element, comprising a support having on one surface thereof said polymeric dye-migration barrier layer, to said paper substrate such that the barrier layer is adhered to said paper substrate, and thereafter separating said support from said barrier layer.

7. The process of claim 1 wherein said intermediate receiver element comprises an intermediate support bearing on one surface thereof said dye image-receiving layer, and wherein step (c) comprises laminating said intermediate receiver element to said paper substrate such that the imaged dye image-receiving layer is adhered to said dye-migration barrier layer, and thereafter separating said intermediate support from the said image-receiving layer.

8. The process of claim 7 wherein said dye-migration barrier layer comprises a polymeric binder containing said crosslinked polymeric particles.

9. The process of claim 7 wherein said dye-migration barrier layer comprises a polymer containing a crystallizable plasticizer which is a polyester having the formula:

$$(I) —[—CO—O—(CH_2)_x—]— \text{ or}$$

$$(II)—[—CO—(CH_2)_x—CO—O—(CH_2)_y—O—]—$$

where x and y can be any integer greater than 1.

10. The process of claim 1 wherein step (a) comprises (i) generating a set of electrical signals which is representative of the shape and color scale of an original image, (ii) contacting a dye-donor element comprising a support having thereon a dye layer and an infrared-absorbing material with an intermediate dye-receiving element comprising an intermediate support having thereon the polymeric dye image-receiving layer, and (iii) using the signals to imagewise-heat by means of a diode laser said dye-donor element, thereby transferring a dye image to said intermediate dye-receiving element.

11. The process of claim 10 wherein said thermal dye transfer image comprises a half-tone color image.

12. The process of claim 1 wherein said thermal dye transfer image comprises a half-tone color image.

13. A color image comprising a paper sheet having on one surface thereof a dye-migration barrier layer and a thermal dye transfer imaged polymeric dye image-receiving layer in that order, such that the thermal dye transfer image is contained between the image-receiving layer and the dye-migration barrier layer;

said dye-migration barrier layer comprising:

(I) crosslinked polymeric particles whose average diameter is equal to or less than about one-half the thickness of said dye-migration barrier layer; or (II) a polymer containing a polymeric crystallizable plasticizer that is at least partially compatible with said polymer and which has a crystalline melting point of less than about 135° C.

14. The color image of claim 13 wherein said thermal dye transfer image comprises a half-tone color image.

15. The color image of claim 13 wherein said dye-migration barrier layer comprises a polymeric binder containing said crosslinked polymeric particles.

16. The color image of claim 13 wherein said dye-migration barrier layer comprises a polymer containing a crystallizable plasticizer which is a polyester having the formula:

$$(I)—[—CO—O—(CH_2)_x—]— \text{ or}$$

$$(II)—[—CO—(CH_2)_x—CO—O—(CH_2)_y—O—]—$$

where x and y can be any integer greater than 1.

17. The color image of claim 16 wherein said polymer is poly(vinyl alcohol-co-butyral) and said crystallizable plasticizer is poly(caprolactone).

* * * * *